United States Patent [19]

Rohr et al.

[11] Patent Number: 4,971,839

[45] Date of Patent: Nov. 20, 1990

[54] HIGH-TEMPERATURE SHIELDING COATING AND METHOD FOR PRODUCING IT

[75] Inventors: Josef Rohr, Absteinach; Wing F. Chu, Leimen, both of Fed. Rep. of Germany

[73] Assignee: BBC, Brown, Boveri & Cie, Baden, Switzerland

[21] Appl. No.: 256,072

[22] Filed: Oct. 6, 1988

Related U.S. Application Data

[63] Continuation of Ser. No. 925,415, Oct. 31, 1986, abandoned.

[30] Foreign Application Priority Data

Nov. 2, 1985 [DE] Fed. Rep. of Germany ..... 3539029

[51] Int. Cl.[5] ..... B05D 1/02; B05D 1/10; B05D 3/02; C09D 1/00

[52] U.S. Cl. ..... 427/372.2; 427/34; 427/423; 106/286.2; 106/286.3; 106/286.6

[58] Field of Search ..... 427/34, 423, 376.2, 427/376.5, 372.2, 377; 106/286.2, 286.3, 286.6; 501/152

[56] References Cited

U.S. PATENT DOCUMENTS

| | | | |
|---|---|---|---|
| 3,441,517 | 4/1969 | Brauer et al. | 501/152 |
| 3,610,888 | 10/1971 | Button | 501/152 |
| 4,045,375 | 8/1977 | Komata | 501/152 |
| 4,052,532 | 10/1977 | Tannenberger et al. | 429/33 |
| 4,117,208 | 9/1978 | Ludang | 429/104 |
| 4,160,069 | 7/1979 | Johnson et al. | 429/163 |
| 4,186,072 | 1/1980 | Blumenthal et al. | 204/428 |
| 4,305,848 | 12/1981 | Hikita | 501/152 |
| 4,339,511 | 7/1982 | Morgan | 429/189 |
| 4,357,426 | 11/1982 | Murata et al. | 501/152 |
| 4,483,785 | 11/1984 | Johnson et al. | 252/520 |
| 4,562,124 | 12/1985 | Ruka | 501/152 |
| 4,587,225 | 5/1986 | Tsukuma et al. | 501/152 |
| 4,590,090 | 5/1986 | Siemers et al. | 427/34 |
| 4,605,631 | 8/1986 | Rossi | 501/152 |
| 4,631,238 | 12/1986 | Ruka | 501/152 |

*Primary Examiner*—Shrive Beck
*Assistant Examiner*—Marianne L. Padgett

[57] ABSTRACT

A high-temperature shielding coating for structural elements, in particular elements made of an austenitic material, characterized by the metallic mixed oxide system having a perovskite structure and the chemical formula:

$$A_{1-x}B_xMO_3$$

wherein A is a metal from secondary group III, B a metal from primary group II and M a metal from secondary group VI, VII or VIII of the periodic table of chemical elements, and the stoichiometric factor x has a vlaue between 0 and 0.8.

5 Claims, 1 Drawing Sheet

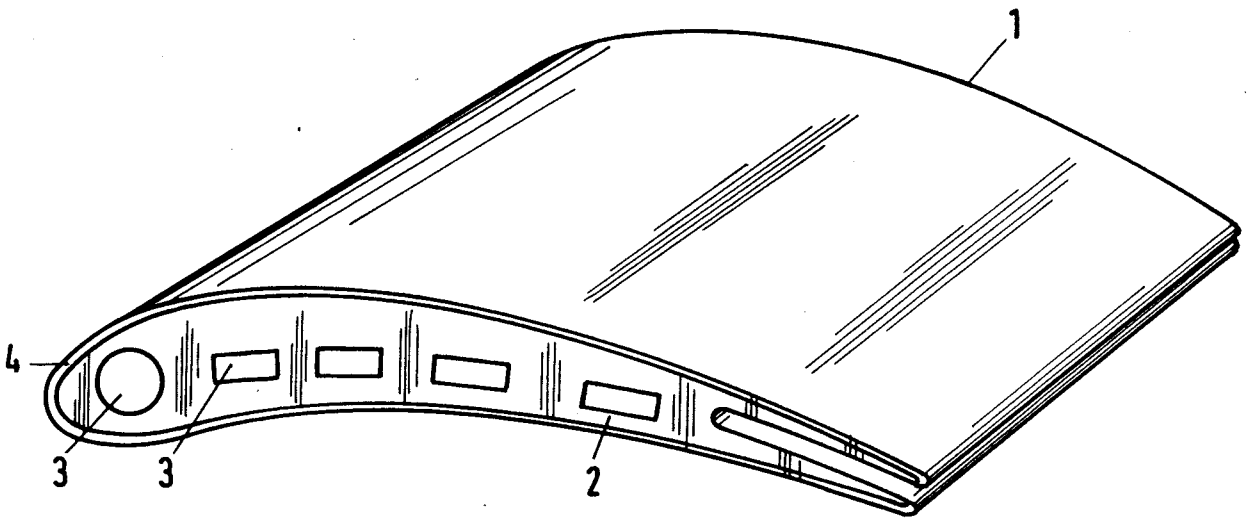
1
2
3
3
4

HIGH-TEMPERATURE SHIELDING COATING AND METHOD FOR PRODUCING IT

This application is a continuation of application Ser. No. 925,415, filed Oct. 31, 1986, now abandoned.

BACKGROUND OF THE INVENTION

1. Field of the Invention

The invention relates to a high-temperature shielding coating for structural elements, in particular elements made of an austenitic steel, and to a method for producing it.

2. Description of the Prior Art

High-temperature shielding coatings of this type are used particularly where the base material of structural elements made of heat resistant steels and/or alloys that are used at temperatures over 600° C. is to be protected. The high-temperature shielding coating is intended to retard the effect of high-temperature corrosion, especially corrosion caused by sulfur/oil ashes, oxygen, alkaline earths and vanadium. The high-temperature shielding coatings are applied directly onto the base material of the structural elements. High-temperature shielding coatings are of particular importance in the case of the structural elements of gas turbines. They are applied especially to impeller and guide blades, as well as to heat-accumulation segments of gas turbines. An austenitic material based on nickel, cobalt or iron is preferably used for manufacturing the structural elements.

SUMMARY OF THE INVENTION

An object of the invention is to provide a method for producing a high-temperature shielding coating, as well as the high-temperature shielding coating itself, which is resistant particularly to corrosive components in hot gases, and which moreover adheres particularily well and durable to the surface of metal structural elements.

With the foregoing and other objects in view, there is provided in accordance with the invention a high-temperature shielding coating for structural elements, in particular an element made of an austenitic material, comprising a metallic mixed oxide system having a perovskite structure and the chemical formula:

$$A_{1-x}B_xMO_3,$$

wherein A is a metal from the secondary group III, B is a metal from the primary group II and M is a metal selected from the secondary group VI, VII and VIII of the periodic table of chemical elements, and the stoichiometric factor x has a value between 0 and 0.8.

There is provided in accordance with the invention a method for producing a high-temperature shielding coating for structural elements, in particular an element made of an austenitic material, comprising a metallic mixed oxide system having a perovskite structure and the chemical formula;

$$A_{1-x}B_xMO_3,$$

wherein A is a metal from the secondary group III, B is a metal from the primary group II and M is a metal selected from the secondary group VI, VII and VIII of the periodic table of chemical elements, and the stoichiometric factor x has a value between 0 and 0.8 which comprises, forming a metallic mixed oxide system having a perovskite structure and chemical formula as defined above by grinding and mixing A, B and M in stoichiometric proportions, compressing the mixture, sintering the mixture in an oxidizing atmosphere, grinding the sintered mixture to a powder, and applying the ground sintered powder to a base body, which is to be coated, of a structural element.

In accordance with the invention a method for producing a high-temperature shielding coating for structural elements, in particular an element made of an austenitic material, comprising a metallic mixed oxide system having a perovskite structure and the chemical formula;

$$A_{1-x}B_xMO_3,$$

wherein A is a metal from the secondary group III, B is a metal from the primary group II and M is a metal selected from the secondary group VI, VII and VIII of the periodic table of chemical elements, and the stoichiometric factor x has a value between 0 and 0.8 which comprises, directing elements A, B and M in the form of compounds selected from the group consisting of halides, oxyhalides, hydrides, carbonyls and metallo-organic compounds, together with a carrier gas containing oxygen, onto the surface, which has been heated to a temperature of 300 to 1000° C., of the structural element that is to be coated, to effect precipitation of the elements A, B and M on the surface of the structural element in the form of a mixed oxide system having a perovskite structure.

In another embodiment of the invention a method for producing a high-temperature shielding coating for structural elements, in particular an element made of an austenitic material, comprising a metallic mixed oxide system having a perovskite structure and the chemical formula;

$$A_{1-x}B_xMO_3,$$

wherein A is a metal from the secondary group III, B is a metal from the primary group II and M is a metal selected from the secondary group VI, VII and VIII of the periodic table of chemical elements, and the stoichiometric factor x has a value between 0 and 0.8 which comprises, incorporating the metal components A, B and M into the alloy used for producing the structural element, heating the structural element containing the metal components A, B and M in an atmosphere containing oxygen to cause the metal components A, B and M to diffuse to the surface and react with the oxygen in the surrounding atmosphere to form the mixed oxide system having the perovskite structure.

In another embodiment, a method for producing a high-temperature shielding coating for structural elements, in particular an element made of an austenitic material, comprising a metallic mixed oxide system having a perovskite structure and the chemical formula;

$$A_{1-x}B_xMO_3,$$

wherein A is a metal from the secondary group III, B is a metal from the primary group II and M is a metal selected from the secondary group VI, VII and VIII of the periodic table of chemical elements, and the stoichiometric factor x has a value between 0 and 0.8 which comprises, introducing the metal components A, B and M into the structural element by vapor deposition or sintering-in with the exclusion of oxygen, subsequently heating the structural element containing the metal components A, B and M in an atmosphere containing oxygen to cause the metal components A, B and M to diffuse to the surface and react with the oxygen in the surrounding atmosphere to form the mixed oxide system having the perovskite structure.

In a still further embodiment a method for producing a high-temperature shielding coating for structural elements, in particular an element made of an austenitic material, comprising a metallic mixed oxide system having a perovskite structure and the chemical formula;

$$A_{1-x}B_xMO_3,$$

wherein A is a metal from the secondary group III, B is a metal from the primary group II and M is a metal selected from the secondary group VI, VII and VIII of the periodic table of chemical elements, and the stoichiometric factor x has a value between 0 and 0.8 which comprises, introducing the metal components A and B into a structural element to be coated which already contains the metal component M in its surface, by treating the surface of the structural element of be coated with a solution containing as solutes compounds selected from the group consisting of salts of the metal component A and the metal component B and metalloorganic compounds of the metal component A and the metal component B, heating the treated structural element in the presence of oxygen to react with the metal component contained in the structural element and to form the mixed oxide system having the perovskite structure.

Other features which are considered as characteristic for the invention are set forth in the appended claims.

Although the invention is illustrated and described herein as embodied in high-temperature shielding coating and method for producing it, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawing, which diagrammatically illustrates a structural element of a gas turbine which comes in contact with hot gases and is protected from their corrosive effect by a high-temperature shielding coating formed from a mixed oxide system that has a perovskite structure.

DESCRIPTION OF THE PREFERRED EMBODIMENTS

The invention relates to a high-temperature shielding coating and to a method for producing it. The high-temperature shielding coating according to the invention is formed by a mixed oxide system that has a perovskite structure. The composition of the mixed oxide system is expressed by the general formula $$A_{1-x}B_xMO_3$$

The metal component A is a metal of the third secondary group of the periodic table of chemical elements; the metal component B is a metal of the second primary group; and the metal component M is a metal of the sixth, seventh or eighth secondary group. The value of x is between 0 and 0.8. Preferably the mixed oxide system has lanthanum, strontium and chromium as its metallic components. Mixed oxide systems having a perovskite structure, such as are used for forming the high-temperature shielding coating according to the invention, occupy a position between pure metals or alloys, on the one hand, and ceramic materials, on the other. The density of these mixed oxide systems is relatively high, similar to that of metals. Their hardness exceeds that of metals, and is comparable to that of ceramic materials. The same applies to their mechanical strength. The thermodynamic and chemical stability of these mixed oxide systems, and their phase stability as well, even exceed that of other high-temperature materials within wide temperature ranges. The coefficient of expansion of the mixed oxide systems is between that of metals and ceramic. The high-temperature shielding coating according to the invention also has the property that it is resistant to sulfur, halogens, and vanadium and their compounds as well as to alkali salts and metal oxides. Furthermore it has very good adhesiveness to metal structural elements, and is durable as well. It has the necessary mechanical strength as well as the necessary resistance to erosion.

Furthermore, it is distinguished by adequate gastightness as well as very good thermal shock resistance in the temperature range in which it is used.

The invention will now be described in greater detail, referring to the drawing.

The drawing of the application shows the structural element 1 of a gas turbine in a vertical section, which comes into continuous contact with hot gases. The structural element 1 has a base body 2, which in the exemplary embodiment shown here is manufactured from an austenitic material based on nickel, iron or cobalt. The base body 2 is penetrated by conduits 3, through which a cooling medium can be passed. The high-temperature shielding coating 4 may be applied to the surface of the base body 2 at a thickness of about 100 μm. The high-temperature shielding coating 4 can be applied directly to the surface of the cleaned base body 2. The high-temperature shielding coating is formed by means of a mixed oxide system that has a perovskite structure having the general composition:

$$A_{1-x}B_xMO_3$$

In this formula, A stands for a metal from the third secondary group; B stands for a metal from the second primary group; and M stands for a metal from the secondary group VI, VII or VIII of the periodic table of the elements. The stoichiometric factor x has a value between 0 and 0.8, preferably between 0 and 0.4.

To produce a suitable powder, the oxides or carbonates of these metals are mixed, ground, pressed and sintered in accordance with the following chemical equation:

$$\tfrac{1}{2}(1-x)A_2O_3 + xBO + \tfrac{1}{2}M_2O_3 + (\tfrac{1}{4})xO_2 \xrightarrow[\text{AIR}]{1500^\circ\text{ C.}} A_{(1-x)}B_xMO_3$$

The reaction product is then processed into a powder capable of being sprayed.

In the exemplary embodiment shown here, the powder is produced from lanthanum, strontium and chromium before the high-temperature shielding coating 4 is formed. The stoichiometric factor x has the value of 0.16 in the exemplary embodiment described here. The oxides of lanthanum, strontium and chromium are mixed and ground in a ball mill or vibrating mill. Next, they are compressed in a pressing mold at a pressure of from $10^8$ to $2\times10^8$ $M/m^2$ (newtons per square meter) and then sintered for several hours at 1500° C. under the influence of air. During this time the following reaction takes place:

$$(\tfrac{1}{2})O.84La_2O_3 + O.16SrO + \tfrac{1}{2}CrO_3 + O.04O_2 \xrightarrow[\text{air}]{1500^\circ\text{ C.}} La_{O.84}Sr_{O.16}CrO_3$$

$SrCO_3$ can be used instead of SrO. The product of the solids reaction can be ground in a vibrating mill to a powder having a particle size of from 0.1 to 60 μm.

Powder having a particle size between 10 and 60 μm is applied to the surface of the base body 2 with the aid of the known flame-spraying or plasma-spraying. According to the invention, the high-temperature shielding coating 4 desirably has a thickness of approximately 100 μm. Instead of the plasma-spraying method, if a very fine sinter-active powder having a particle size between 0.1 and 10 μm is used, then the material forming the high-temperature protective coating 4 can be sprayed as a suspension onto the surface of the base body 2, or can be applied from the suspension by electrophoresis and then fired by subsequent heating of the structural element 1 to 800 to 1200° C. A film-forming medium, such as nitrocellulose amyl acetate, can be added to the suspension if conditions require it.

In another embodiment of the method according to the invention, the starting materials of the mixed oxide system used for producing the high-temperature shielding coating is directed, in the form of gaseous reactive compounds together with an oxygen-containing carrier gas, onto the heated surface of the structural element that is to be coated. Because of the high temperatures, these gaseous compounds interact and react with the material of the structural element 1. The mixed oxide system to be formed is also again intended to be at least one metal of the third secondary group, one metal of the second main group and one metal of the sixth, seventh or eighth secondary group of the periodic table of chemical elements. In particular, the mixed oxide here is to have the general structural formula $A_{1-x}B_xMO_3$. Preferable gaseous compounds for forming the mixed oxide having the perovskite structure are halides, oxyhalides, hydrides, carbonyls or metallo-organic compounds. Preferably, lanthanum is used as metal A, strontium as metal B and chromium as metal M for forming the high-temperature shielding coating. Nitrogen or argon with $O_2$ is used as the oxygen-containing carrier gas. Additionally, oxygen-containing reaction substances such as $O_2$, air or $H_2O$ can be mixed with the gaseous reactive compounds.

In another procedure of producing the high-temperature shielding coating 4 according to the invention, the structural element 1 to be coated is made from an alloy which contains the metal components A, B and M that are required for forming the mixed oxide systems in suitable mole ratios.

If the base body 2 of the structural element 1 that is to be provided with the high-temperature shielding coating 4 is manufactured from an alloy that contains lanthanum, strontium and chromium in the required amounts, then by means of a heat treatment of the base body 2 in an oxygen-containing atmosphere, these metal components diffuse to the surface and react with oxygen such that a high-temperature shielding coating 4 comprising the desired mixed oxide system is formed, with the mixed oxide system having a perovskite structure.

A further embodiment for producing the high-temperature shielding coating 4 on the base body 2 can be accomplished by vapor-depositing the required metal components onto the surface after the base body 2 has been manufactured, or by doping them into it. By means of an ensuing heat treatment in an oxygen-containing atmosphere, the desired high-temperature shielding coating comprising the mixed oxide system having the perovskite structure, can once again be produced. In many applications, the structural element 1 that is to be coated already contains the metal component M in its base body 2, in the form of a component of iron, cobalt, nickel, manganese or chromium. This means that the components A and B which are additionally required for forming the mixed oxide system need merely be introduced into the base body and made to react with the metal component M by diffusion or oxidation processes at an elevated temperature.

Another method for coating the structural component can be applied when the base body 2 of the structural element 1 already contains in its surface the metal component M as an alloy ingredient. In this case, the surface of the base body 2 is treated with a solution comprising a salt or metallo-organic compound of the two metal components A and B. A nitrate solution which contains the two metal components A and B may be used. Next, the structural element 1 is heated to the temperature of decomposition of the salt or metallo-organic compound or nitrate compound. This all takes place under the influence of oxygen. Because of the action of temperature, a reaction takes place between the metal component M contained in the surface of the structural element 1 and the metal components A and B applied to the surface. The desired mixed oxide system with the perovskite structure is thereby formed. The reactions that occur are represented in the following equation:

$$\text{M (in base body 2)} + (1-x)A(NO_3)_3 + xB(NO_3)_2 + x/2O_2 \text{ (air)} \xrightarrow[\text{treatment}]{\text{heat}} \text{base body} + A_{1-x}B_xMO_3 + (3-x)NO_2$$

The two components A and B may be precipitated out of the solution of their salt or metallo-organic compound onto the surface of the metal component M either catalytically or electrolytically and by an ensuing heat treatment under the influence of oxygen causing them to react with the metal component M that is already contained in the surface of the base body. In this reaction, the desired metal oxide system having a perovskite structure forms on the surface in the form of a shielding coating.

The foregoing is a description corresponding, in substance, to German application P 35 39 029.8, dated Nov. 2, 1985, International priority of which is being claimed for the instant application, and which is hereby made part of this application. Any material discrepancies between the foregoing specification and the specification of the aforementioned corresponding German application are to be resolved in favor of the latter.

There is claimed:

1. A method for producing a high-temperature coating for austenitic metallic components subject to high temperatures said coating comprising a mixed oxide composition having a perovskite structure and the chemical formula $$La_{0.84}Sr_{0.16}FeO_3$$

prepared by mixing, said composition being prepared by the process comprising the steps of mixing the following compounds in about the stated proportions $$(\tfrac{1}{2})0.84La_2O_3+0.16SrO+\tfrac{1}{2}Fe_2O_3+0.04O_2$$

after the mixing, compressing the resulting mixture at a pressure in the range, sintering the compressed mixture in air at a temperature of substantially about 1500° C., grinding said sintered mixture to a powdered particle size, substantially in the range 10 to 60 μm;

then coating said austenitic metallic structure with the ground sintered powder to a thickness of about 100 μm and thereafter heating said powder-coated metallic component to a temperature in the range 800 to 1200° C.

2. A method for producing a high-temperature coating for austenitic metallic components subject to high temperatures, said coating comprising a mixed oxide composition having a perovskite structure and the chemical formula $$La_{0.84}Sr_{0.16}Mn_2O_3$$

prepared by mixing, said composition being prepared by the process comprising the steps of mixing the following compounds in about the stated proportions $$(\tfrac{1}{2})0.84La_2O_3+0.16SrO+\tfrac{1}{2}Mn_2O_3+0.040_2$$

after the mixing, compressing the resulting mixture at a pressure in the range (claim 2), sintering the compressed mixture in air at a temperature of substantially about 1500° C., grinding said sintered mixture to a powdered particle size, substantially in the range 10 to 60 μm;

then coating said austenitic metallic structure with the ground sintered powder to a thickness of about 100 μm and thereafter heating said powder-coated metallic component to a temperature in the range 800° to 1200° C.

3. A method for producing a high-temperature coating for austenitic metallic components subject to high temperatures, said coating comprising a mixed oxide composition having a perovskite structure and the chemical formula $$La_{0.84}Sr_{0.16}CoO_3$$

prepared by mixing; said composition being prepared by the process comprising the steps of mixing the following compounds in about the stated proportions $$(\tfrac{1}{2})0.84La_2O_3+0.16SrO+\tfrac{1}{2}CoO_3+0.04O_2$$

after the mixing, compressing the resulting mixture at a pressure in the range (claim 3), sintering the compressed mixture in air at a temperature of substantially about 1500° C., grinding said sintered mixture to a powdered particle size, substantially in the range 10 to 60 μm;

then coating said austenitic metallic structure with the ground sintered powder to a thickness of about 100 μm and thereafter heating said powder-coated metallic component to a temperature in the range 800 to 1200° C.

4. A method for producing a high-temperature coating for austenitic metallic components subject to high temperatures, said coating comprising a mixed oxide composition having a perovskite structure and the chemical formula $$La_{0.84}Sr_{0.16}NiO_3$$

prepared by mixing, said composition being prepared by the process comprising the steps of mixing the following compounds in about the stated proportions $$(\tfrac{1}{2})0.84La_2O_3+0.16SrO+\tfrac{1}{2}NiO_3+0.04O_2$$

after the mixing, compressing the resulting mixture at a pressure in the range (claim 4), sintering the compressed mixture in air at a temperature of substantially about 1500° C., grinding said sintered mixture to a powdered particle size, substantially in the range 10 to 60 μm;

then coating said austenitic metallic structure with the ground sintered powder to a thickness of about 100 μm and thereafter heating said powder-coated metallic component to a temperature in the range 800° to 1200° C.

5. A method for producing a high-temperature coating for austenitic metallic components subject to high temperatures, said coating comprising a mixed oxide composition having a perovskite structure and the chemical formula $$La_{0.84}Sr_{0.16}CrO_3$$

prepared by mixing, said composition being prepared by the process comprising the steps of mixing the following compounds in about the state proportions $$(\tfrac{1}{2})0.84La_2O_3+0.16SrO+CrO_3+0.04O_2$$

after the mixing, compressing the resulting mixture at a pressure in the range (claim 5) $10^8$ to $2\times10^8$ N/m$^2$, sintering the compressed mixture in air at a temperature of substantially about 1500° C., grinding said sintered mixture to a powdered particle size, substantially in the range 10 to 60 μm;

then coating said austenitic metallic structure with the ground sintered powder to a thickness of about 100 μm and thereafter heating said powder-coated metallic component to a temperature in the range 800° to 1200° C.

* * * * *